United States Patent [19]

Elsner et al.

[11] 3,965,333

[45] June 22, 1976

[54] SEAL TEMPERATURE CONTROL MEANS FOR CURTAIN-TYPE WRAPPING MACHINE

[75] Inventors: Bertram F. Elsner; Frank Elsner, Jr., both of Hanover, Pa.

[73] Assignee: Elsner Engineering Works, Inc., Hanover, Pa.

[22] Filed: June 9, 1975

[21] Appl. No.: 585,305

[52] U.S. Cl. ..... 219/243; 53/33; 93/DIG. 1; 156/515; 338/316

[51] Int. Cl.[2] ..... H05B 1/00

[58] Field of Search ..... 219/243; 53/33; 93/DIG. 1; 156/515, 583; 338/315, 316

[56] References Cited

UNITED STATES PATENTS

| | | | |
|---|---|---|---|
| 3,299,251 | 1/1967 | Zelnick | 219/243 |
| 3,461,271 | 8/1969 | Reitzes | 219/243 |
| 3,569,667 | 3/1971 | Ryswick | 219/243 |

*Primary Examiner*—C. L. Albritton
*Attorney, Agent, or Firm*—C. Hercus Just

[57] ABSTRACT

Temperature control means for a curtain-type wrapping or banding machine to prevent excess ambient temperature thereon by employing switch-actuating means responsive to even very small changes in the expansion and contraction of the elongated heating element on the heater bar of the machine which co-acts with the anvil thereof to effect sealing of either a web or bands of thermoplastic synthetic resin material around various types of objects of various sizes and also re-constitute the web or bands into continuous form incident to severing the sealed web or bands from the supply material.

6 Claims, 3 Drawing Figures

SEAL TEMPERATURE CONTROL MEANS FOR CURTAIN-TYPE WRAPPING MACHINE

CROSS-REFERENCE TO RELATED APPLICATION

The present invention is applicable as an improvement to the curtain-type wrapping machine comprising the subject matter of applicants' copending application Ser. No. 523,883, filed Nov. 14, 1974.

BACKGROUND OF THE INVENTION

The present invention comprises an addition to an improvement in one of the important elements of the curtain-type wrapping and banding machines comprising the subject matter of applicants' prior U.S. Pat. Nos. 3,775,939, issued Dec. 4, 1973 and 3,866,389, issued Feb. 18, 1975. The inventions covered by said patents as well as the invention comprising the subject matter of said aforementioned related co-pending application, Ser. No. 523,883, filed Nov. 14, 1974, pertain to extending either bands or sheet films of heat shrinkable plastic material around certain objects such as rolls of sheet material, such as wrapping paper and many other types of sheet material, so as either to enclose such objects circumferentially with such sheet films or all bands which are disposed curtain-like across the path of oncoming articles to be enclosed and then sealing said sheet film or bands around the articles, separate the enclosing material from the supply of the same and then re-constitute the curtain arrangement of the enclosing material.

The foregoing operation of sealing and re-constituting the enclosing sheet film or band type material, which is also thermoplastic, comprises an elongated anvil bar which extends transversely across the machine adjacent the path of movement of the articles to be encircled with the material and a heater bar of similar length which also extends transversely across the machine adjacent said path of the articles and mechanism is included in the machines to move at least one of said bars toward the other or, if desired, move both of said bars toward and from each other to effect such sealing and re-constituting of the thermoplastic material after certain lengths thereof have been encircled around the objects. When bands of heat shrinkable material are employed, they are used to prevent uncoiling of the material from rolls thereof which are sequentially passed through the machine and when sheet film material is employed, it usually extends at least to the opposite ends of the rolls as well as beyond so as to form a wrapper for the object such as coiled rolls of sheet material.

The heater bar usually carries an elongated electrical resistance element such as a wire or narrow strip which extends along the operative face of the heater bar which is in opposition to the operative face of the anvil bar, the resistance element extending substantially the full length of the heater bar. Electric current is supplied to the resistance element by specialized equipment comprising an electrical thermal impulse generator, one popular type of which is manufactured and sold by the Vertrod Corp. of Brooklyn, N.Y. Said generator comprises a series of current transformer and timer units arranged in suitable circuitry within the generator. The function of such generator is to "fire" an impulse of relatively high amperage through the resistance element at the time it is brought into engagement with films or strips of thermoplastic synthetic resin film sheets or bands which extend across the anvil bar so as simultaneously to seal overlying portions of the films or strips which encircle objects around which they extend, sever the encircling material which has just been sealed and immediately re-constitute the severed ends of the material from the supply thereof so as to reestablish a curtain-type arrangement of either the film sheets or bands of material which are engaged by the next oncoming object to be encircled thereby.

As a result of continuous use of the aforementioned apparatus to seal, sever and re-constitute the sheet film or bands of heat shrinkable plastic material comprising synthetic resin, there is a tendency for residual heat to accumulate in the heater bar and the immediate ambient atomsphere which has been found to result in expansion of the electrical resistance element on the heater bar and even produce a limited amount of sagging in the same. Further, the increase in temperature resulting from such continuous use also increases the temperature at which the sealing, severing and re-constituting is effected and this phenomenon causes reduction in cperating time due to having to allow an additional time segment in the foregoing operation to permit the thermoplastic material to cool incident to forming a union of the edges of the sheet film or strips incident to re-constituting the same, as well as to effect a satisfactory seal of the material around the articles enclosed thereby. In some circumstances, it even has been necessary to provide auxiliary cooling equipment to effect such seals and reconstituted unions of the materials.

In an effort to overcome the foregoing difficulty, several attempts have been made to provide control equipment to limit the supply of heating current to the electrical resistance elements of the sealing means, the control being responsive to the amount of expansion and contraction of the resistance element. One such example comprises the subject matter of U.S. Pat. No. 3,299,251, dated Jan. 17, 1967, to S. Zelnick and a more recent example is the subject matter of U.S. Pat. No. 3,840,722, issued Oct. 8, 1974, to Rolf Mayer et al. The Zelnick apparatus includes a somewhat complex fluid system employing oil from a reservoir and includes flow control valves, bypasses and the like as well as one way ball check valves which control the operation of electrical contacts which comprise switch means to control the flow of current to the electrical resistance wire of the heater unit. The Mayer et al. patent includes an arrangement whereby the electrical resistance element has one end anchored to a spring to maintain the element taut incident to the expanding and contracting thereof but in doing so, the element is stressed by a spring which is stated in the specification to be a compression spring and, as such, it is directly dependent upon the switch structure, which is not shown. Hence, the sensitivity of adjustment is directly related to the contacting action within the switch which as described in Zelnick, is a poor arrangement which lacks sensitivity.

The desired objective relative to controlling the amount of the ambient heat as well as the limits of expansion and contraction of the electrical resistance element in the sealing mechanism of wrapping and banding machines of the type referred to above is to minimize the amount of current supplied to the resistance element while maintaining the same taut, the supply of current to the heating element being controlled by switch means which is responsive to extremely small amounts of expansion and contraction so as to render the control mechanism extremely sensitive to such very small increments of increase or decrease in the length of the resistance element. An ideal arrangement to accomplish this is provided by the present invention, details of which are set forth hereinafter.

SUMMARY OF THE INVENTION

It is the principal object of the present invention to provide for use in a curtain-type overwrapping machine an elongated heater bar having an electrical resistance element extending longitudinally therealong and adapted to have imposed thereon, incident to effecting sealing and reconstituting operations on thermoplastic film sheets and band materials, an instantaneous current generated by a thermal impulse generator to develope temperatures in the resistance element of the range of approximately between 300°F. and 400°F., the improvement primarily comprising movable elements directly responsive to very small increments of change in the length of the resistance element resulting from expansion and contraction thereof, said movable elements actuating a micro-switch controlling the supply of current to said generator, said movable elements also being highly sensitive to such small increments of change in length of the resistance element, whereby minimum amounts of current are consumed in providing the range of temperatures indicated above so as to result in no abnormal increase in ambient heat in the vicinity of the heater bar and thereby eliminate any necessity of decreasing the speed or rate of operation of the machine or introducing auxiliary cooling means.

It is another object of the invention to employ in the actuating means for the control switch in the circuit of the generator a pivoted lever which is mounted in a manner to effect movement of such lever in response to very small increments of expansion in the length of the resistance element on the heater bar and thereby cause the lever to operate a micro-switch comprising the control means in the circuit to the generator so as to interrupt the supply of current to the generator without decreasing the amount of heat produced in the resistance element during a sealing operation by the heater bar.

A still further object of the invention is to provide relatively simple means to effect adjustment of the control mechanism for the generator in a manner to insure operation of the heater bar within the aforementioned temperature range, whereby, for example, ultimate limited elongation of the resistance over a substantial period of time can be compensated for and still maintain the sealing temperature within the desired optimum and minimum limits such as in the exemplary range referred to above.

In general, it is the overall objective of the heater bar and the generator which supplys current thereto to operate in a manner so that the initial seal and re-constituting operation of the machine is effective, as well as all successive and subsequent sealing operations, the seals and reconsitituted curtain arrangement of thermoplastic material effected thereby being of a fully satisfactory commercial nature and such operation of the sealing bar also being such that it minimizes the amount of electrical current required to operate the same satisfactorily, produces better joint uniformity both in the reconstituted thermoplastic material as well as in the sealed joint formed in thermoplastic banding and wrapping material, and also provides longer service life for the resistance element comprising the heating means for the heater bar. In particular however, effectively controlling the maximum sealing temperature, which also is that which reconstitutes the thermoplastic material, obviates any need to reduce the production speed of the machine or employ auxiliary cooling such as is necessary in certain instances where over-heating and the resulting ambient temperature of too high a degree is experienced in wrapping and banding machines to the type to which the present invention pertains that ave been produced heretofore.

Details of the foregoing objects and of the invention, as well as other objects thereof, are set forth in the following specification and illustrated in the accompanying drawings comprising a part thereof.

DETAILED DESCRIPTION

Figure 1:
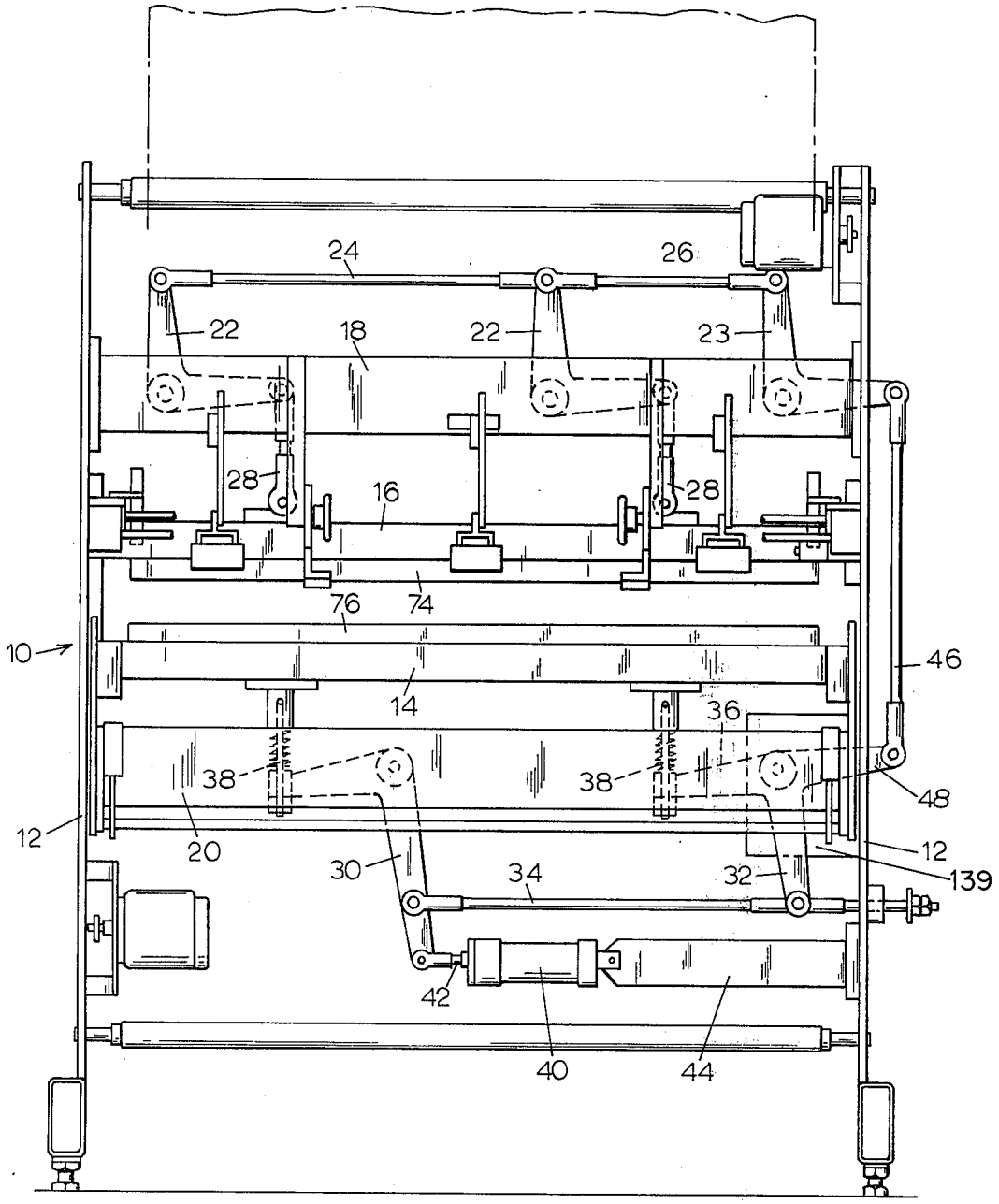
FIG. 1 is a vertical elevation of a curtain-type wrapping and banding machine as viewed immediately adjacent the anvil and heater bars which effect the sealing and reconstituting of thermoplastic synthetic resin material employed to form either wrappers or bands around objects such as rolls of material and otherwise.

As indicated above, the present invention primarily comprises an improvement over an addition to the curtain-type overwrapping machine comprising the subject matter of applicants' prior U.S. Pat. No. 3,866,389, issued Feb. 8, 1975. For details of the operating structure of the entire machine, attention is directed to said patent. However, in view of the fact that the present invention pertains primarily to the heater bar employed in the curtain-type over-wrapping machine illustrated, described and claimed in said prior patent, the drawings of the present application primarily pertain to said heater bar and particularly to the means for controlling the temperature of the resistance element which extends along the operative face of said heater bar which co-operates with the corresponding operative face of the anvil bar. For an understanding of the basic operation of said heater bar and anvil bar, attention is directed to FIG. 1 which corresponds to FIG. 3 of said prior U.S. patent and in which the following details are illustrated.

The wrapping machine 10 has opposite side frame plates 12 between which an elongated anvil bar 14 and an elongated heater bar 16 extends between the opposite sides of said frame. In this particular construction, the anvil bar and heater bar are movable toward each other but it is to be understood that if desired, only one of these bars need be moved toward the other to effect sealing of either a wrapper film or bands of thermoplastic, preferably heat-shrinkable, synthetic resin when extended around an object to be enclosed thereby and said film or bands being sealed around the object, while smultaneously, the ends of the supply means of said film or bands, which have been separated from the encircling portions thereof, are re-united and thereby said curtain-type arrangement being re-constituted.

The mechanism for moving the anvil and heater bars toward and from each other comprises an upper transverse support plate 18 and a corresponding lower transverse support plate 20, the ends of said plate 18 and 20 being suitably connected to the side frame plates 12 in a fixed manner. The upper support plate 18 supports a pair of similar bell cranks 22 and an additional bell crank 23, said bell cranks being supported upon the plate 18 by their intermediate pivots. Upper legs on the bell crank 22 are connected by a connecting rod 24 and an additional connecting rod 26 extends between the upper leg of the bell crank 23 and the next adjacent bell crank 22, as clearly shown in FIG. 1. The horizontal arm of bell cranks 22 are pivotally connected to the upper ends of links 28 which extend downwardly and are pivotally connected to the heater bar 16.

The lower support plate 20 has the bell crank 30 pivotally connected thereto intermediately of its ends and a T-bar 32 is pivotally connected at the junction of all of its arms to the lower support plate 20. The downwardly extending legs of bell crank 30 and T-bar 32 are connected together by a connecting rod 34. The horizontal leg of bell crank 30 and one leg 36 of T-bar 32 respectively are connected to push rods 38 which extend downwardly from anvil bar 14, said push rods 38 raising and lowering the anvil bar 14. A fluid-operated cylinder 40 has a piston rod 42 connected to an extention on the downwardly extending leg of bell crank 30, the cylinder being supported by a fixed bracket 44 which is attached to one of the side frame plates 12. For purposes of simultaneously operating the anvil bar 14 and heater bar 16, another connecting rod 46 extends between the horizontal arm of bell crank 23 and the leg 48 of T-bar 32 which is opposite the leg 36 thereof.

As will be obvious from the arrangement in FIG. 1, when the fluid-operated cylinder 40 is actuated to project or retract the piston rod 42 thereof, it will be seen that the various connecting rods 24, 26, 34, and 46 all function to simultaneously move the anvil bar 14 and the heater bar 16 within a vertical plane, toward and from each other, depending upon the movement of the piston rod 42. Such arrangement is all included in the prior structure of said aforementioned U.S. Pat. No. 3,866,389.

Figure 2:
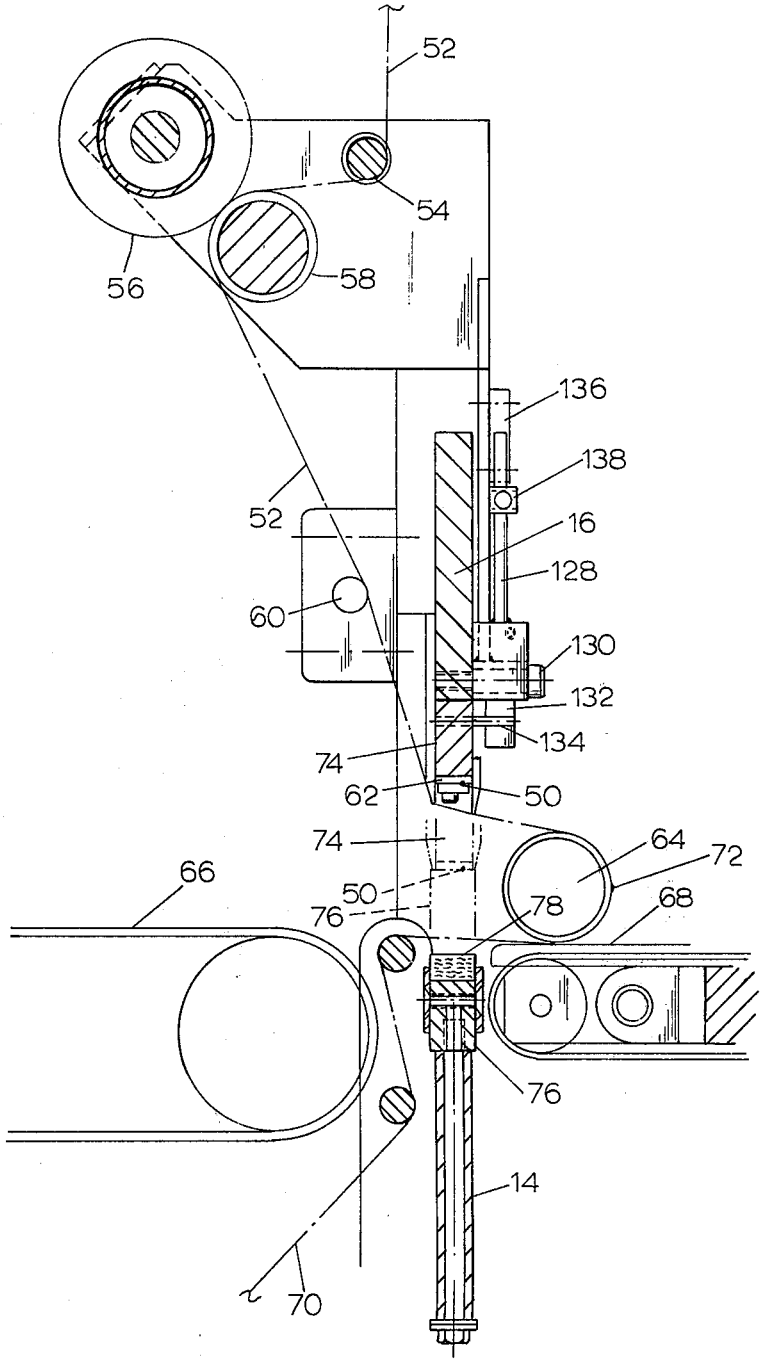
FIG. 2 is a fragmentary vertical sectional view employing a larger scale than used in FIG. 1 and illustrating in greater detail the anvil and heater bars shown in FIG. 1 and also illustrating a portion of the details of the improvement comprising the present invention.

In the following description, the heater bar 16 is the one which supports the resistance element 50 but, if desired, the anvil bar and heater bar may be reversed within the purview of the present invention. As indicated above, the present invention primarily is concerned with controlling the flow of current to the resistance element 50 on the lower face of heater bar 16 and attention is primarily directed to FIG. 3 in which the details of the temperature controlling means primarily are illustrated although certain details are also shown in FIG. 2. Said details are as follows.

Referring to FIG. 2, it will be seen that one film or band of thermoplastic, preferably heat-shrinkable, synthetic resin material 52, which is uncoiled from a roll of the same, not shown, extends around a guide bar 54, between opposing rolls 56 and 58, past another guide bar 60 and then across the lower face of heater bar 16. Said lower face preferably is provided with a layer of suitable resilient material 62 such as silicone rubber, or "Teflon," which is tetrafluorethylene and is capable of resisting the temperatures developed within the resistance element 50. A certain amount of cushioning of the resistance element 50 also is afforded by the material 62.

As viewed in FIG. 2, it will be seen that a cylindrical object 64, which may be a coiled roll of sheet material of some type, or any other object of different shape, is delivered by a feed conveyor 66 onto a receiving member 68 but incident to moving from the conveyor 66 to the receiving member 68, the object 64 engages a curtain-type arrangement of the film or bands of resin material 52. Said curtain-type arrangement is formed by a lower film or bands 70 of synthetic resin material, similar to the film or band 52 thereof, and ends or edges of said films or bands are connected together along a diagrammatic joint or weld 72 which is formed by fusion of the films or bands together, said fusion being effected by the heat of the resistance element 50 during a sealing operation of the same.

After the object 64 has been moved against the composite flim or band of material 52, 70 and is disposed upon the receiving member 68, control mechanism in the machine, which is not illustrated in detail but is of the type illustrated and described in said aforementioned U.S. Pat. No. 3,866,389, the fluid actuated cylinder unit 40 is energized to move the heater bar 16 and anvil bar 14 substantially even distances to the phantom position thereof illustrated in FIG. 2, at which time the resistance element 50 is instantaneously heated by a voltage of high amperage being fired through the resistance element 50 by electrical generator and control means described hereinafter. In the preferred construction, it also will be seen from FIG. 2 that the heater bar 16 is provided with a face strip 74 which is detachably connected thereto and to which the resilient material 62 is attached. Similarly, the upper edge of anvil bar 14 is provided with a face strip or member 76, the upper surface of which supports an elongated strip 78 of high heat resistance material such as silicone rubber, Telfon, or otherwise which affords a limited amount of cushioning at the time the upper and lower portions of the composite film or strip 52, 70 are brought together between the abutting faces of face strips 74 and 76 respectively on the heater bar 16 and anvil bar 14 as illustrated in phantom in FIG. 2, at which time the instantaneous development of fusing heat in the resistance element 50 occurs for purposes of simultaneously effecting sealing of the encircling material around the objects 64, severing said encircling material from the supply portions of the films or bands 52 and 50, and re-uniting said ends of the latter from which the encircling fusable material has been separated. All of the foregoing operation is disclosed in detail in said aforementiond prior U.S. Pat. No. 3,866,389 and to which attention is directed for further details.

Figure 3:
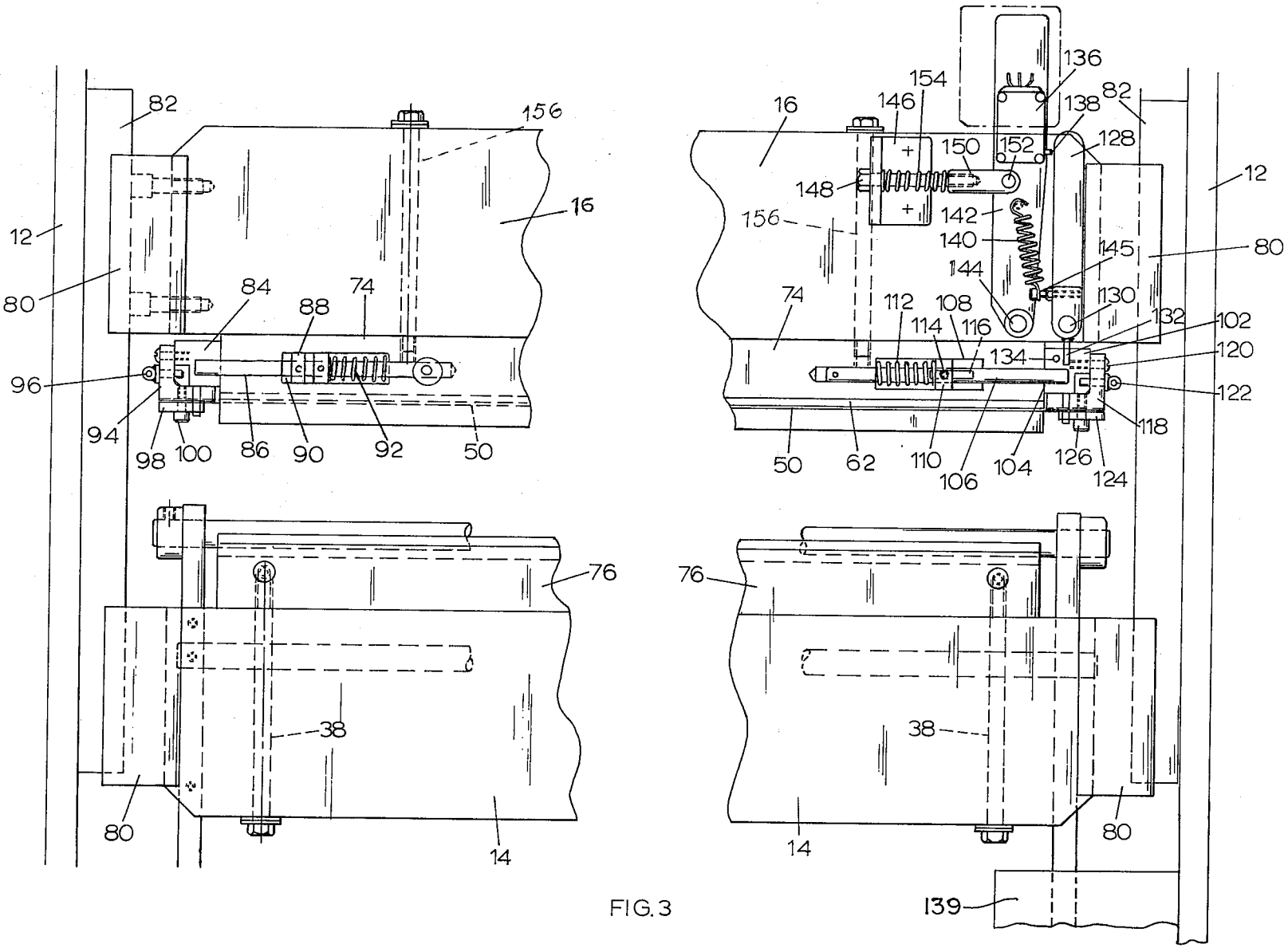
FIG. 3 is a fragmentary vertical elevation employing a larger scale than used in FIG. 1 and illustrating the anvil and heater bars of the present invention, broken away and contracted longitudinally to adapt the figure to the sheet and illustrating details of the opposite ends of said heater bar which illustrate the temperature control mechanism comprising the principal feature of the present invention.

Referring to FIG. 3, details of the mounting of the resistance element 50 and the mechanism and circuitry for supplying current thereto are shown. Said mechanism and at least a portion of the circuitry are carried by the heater bar 16. It also will be noted in FIG. 3 that the opposite ends of the heater bar 16 are provided with channel-like guides 80 which slide on vertical ways 82 supported by the inner faces of the side frame plates 12. The anvil bar 14 also is provided with similar guides 80 for the same purpose.

The left hand end of the foreshortened view of the heater bar 16 includes an insulation block 84 which normally abuts the end face of face strip 74 on bar 16. Block 84 is connected to the outer end of a shaft 86 which is slidable within a slot in face strip 74 and square or rectangular blocks 88 and 89 slide in the enlarged midportion of said slot non-rotatably and are connected to the shaft 86 by set screws. Block 88 determines the length of space 90 which limits the outward movement of block 84. A compression spring 92 on shaft 86 abuts block 89 and extends to the inner end of said slot in strip 74 to urge shaft 86 and block 84 outward.

An L-shaped metallic contact 94 is secured to the outer end of insulation block 84 and a terminal 96 is connected thereto for attachment to an electrical conductor comprising part of the circuit which furnishes current to the resistance element 50 which, incidentally, may either be in the form of a narrow flat strip or it may be of conventional cylindrical wire shape or otherwise. One end of the resistance element 50 is clamped to the contact 94 by a clamping plate 98 which is firmly connected against the element 50 by a suitable bolt 100. The resistance element 50 extends to the opposite end of heater bar 16 and face strip 74 thereon, as is illustrated in the right hand end of the foreshortened heater bar, as illustrated in FIG. 3. An insulation block 102 also is positioned in abutting relationship with the end wall 104 of face strip 74 and is supported by the outer end of a shaft 106 which is slidable within a complementary longitudinally extending opening in face strip 74. Said opening has an enlarged intermediate portion 108 within which a block 110 is slidable and a compression spring 112 surround the inner end of shaft 106 and the opposite ends thereof respectively about the inner end of block 110 and the inner end of the enlarged opening 108. Block 110 is adjustable upon the shaft 106 by means of a set screw 114, the inner end of which clampingly engages a flat 116 formed on one side of shaft 106 as clearly shown in FIG. 3.

Firmly connected to the outer end of insulation block 102 is another L-shaped metallic contact 118 which is secured by screw 120 to the insulation block 102. Another terminal 122 is connected to the metallic contact 118 for another circuit conductor to be connected thereto as well as to the generator and electrical control mechanism which is described hereinafter.

The adjacent end of the resistance element 50 is firmly clamped against the lower face of metallic contact 118 by another clamping plate 124 which is secured in clamping relationship against element 50 by one or more bolts 126.

The principal purpose of the present invention is to provide mechanism and electrical circuitry for the primary purposes of (1) maintaining the resistance element 50 taut at all times so as to prevent sagging, whereby all portions of the element will engage the thermoplastic film or strips simultaneously and (2) to control the supply of current to the element 50 in a manner so that the ambient temperature in the vicinity of the heater bar will be maintained within certain restricted limits of minimum and maximum temperature, thereby providing uniform sealing temperatures which requires no initial warm-up time, from the first seal to the last in any given period of operation of the machine, minimize overheating of the apparatus so as to provide maximum speed of operation without slowing the speed to effect cooling of the seals and welds of the re-constituted material for example, as well as prevent the necessity of using auxillary cooling in an effort to minimize slowing of the speed of operation, as well as effect improved uniformity of sealed joints both in the encircling material around the objects passed through the machine as well as the re-constituted connection of the severed ends of the films and bands, all of which also minimizes power consumption due to the use of only intermittent firing of current through the resistance element, whereby longer service life for the resistance element constitutes another improvement over current operating machines in which, for example, the resistance element is continuously heated. Such continuous heating frequently results in "burning" the thermoplastic films and bands and, where such overheating occurs, operating speed of the machine necessarily must be reduced in order to permit suitable cooling of the seals and welds which re-constitutes the severed ends of the films and welds.

Maintaining the temperature in the vicinity of the resistance element within reasonable limits in accordance with the principles of the present invention is accomplished by the mechanism shown at the right hand end of heater bar 16 in FIG. 3 which comprises a lever 128 which is pivoted on stud 130, adjacent the lower end thereof, to heater bar 16. A short bar 132 is fixed to and projects downwardly from the pivoted end of lever 128 for engagement by a lateral pin 134 on insulation block 102. The upper end of lever 128 is in the same plane as micro-switch 136 and particularly is in line with the micro-switch actuating button 138. It will thus be seen from FIG. 3 that as the resistance element 50 is heated and expands, springs 92 and 112 will act respectively upon shafts 80 and 106 to move the same respectively toward the left and right as viewed in FIG. 3, carrying with them insulation blocks 84 and 102, block 102 also having lateral pin 134 mounted thereon for engagement with short bar 132. The opposite ends of element 50 will move substantially equal distances in both expansion and contaction, thus minimizing wear and stress thereon. Because of the great disparagement in the lengths of the lever arms of the upper end of lever 128 relative to short bar 132 with respect to the pivot 130, an extremely small amount of movement of the short bar 132, as caused by the pin 134, will result in a substantially greater movement of the upper end of lever 128 for purposes of contacting and actuating the button 138 of microswitch 136, it being understood that the switch 136 is connected in the circuit between the generator 139 and the terminals 96 and 122 on opposite ends of the resistance element 50.

Figure 4:
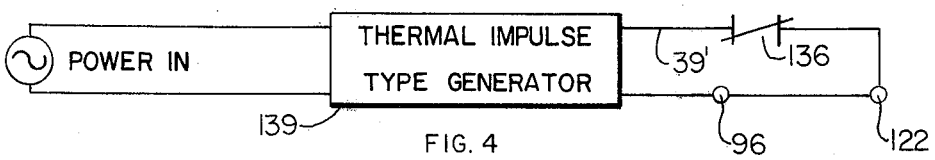
FIG. 4 is a simplified wiring circuit for certain control means in the machine comprising the invention.

The details of generator 139 are not illustrated in the present drawings but FIG. 4 shows a partial circuit for said generator and it is to be understood that the same is a thermal impulse type generator consisting of an arrangement of transformers and timer means which is mounted in the machine generally in the vicinity of the lower portion of the anvil bar 14. One suitable type of such generator is manufactured by the Vertrod Corp. of Brooklyn N.Y., whereby the same is of a standard manufactured type and not of any special type which is required by the present invention. Hence, when the microswitch 136 is actuated by the button 138 thereof, the circuit to the resistance element 50 is interrupted.

Said circuit is shown in simplified manner in FIG. 4 and comprises conductors 139. Also, said element is of the type which cools rapidly, whereby a very limited amount of cooling will result in the element contracting, which results in the upper end of lever 128 disengaging the button 138 of micro-switch 136. Such retracting movement is insured by a spring 140, one end of which is anchored to a vertical support member 142, the lower end of which is pivoted at 144 to heater bar 16. The opposite end of spring 140 is connected to a headed member 145 a short distance above the pivot 130 of lever 128.

In order to adjust the position of micro-switch 136 and especially of its control button 138, the micro-switch 136 is connected to the upper end of vertical support member 142. A bracket 146 is attached to the heater bar 16 and has a perpendicular flange thereon through which a bolt 148 extends. The opposite end of the bolt 148 is threaded into a clevis 150 which is pivotally connected at 152 to the vertical support member 142. A compression spring 154 surrounds bolt 148 between the flange of bracket 146 and clevis 150. Hence, rotation of the bolt 148 will effect movement of the upper end of support member 142 and, correspondingly, of the micro-switch 136 and its button 138 and thereby control the position at which the upper end of lever 128 will engage the button 138.

In the preferred operation of the temperature control mechanism for the resistance element 50, it will be seen that it depends entirely upon the contraction and elongation of the element 50. The initial position of the micro-switch 136 and its button 138 is established empirically in order that, for example, the temperature range within which the element 50 will operate is, for example, of the order of between 300° and 400°F, it being understood that these temperature range limits are merely exemplary rather restrictive. Such temperature range, for example, is highly suitable to effect the sealing of thermoplastic film or bands around objects to be encircled thereby, without burning the material or requiring any appreciable amount of time to permit the seal to cool. Further, effective welding of the severed end of the supply material is achieved without requiring any appreciable amount of time to effect cooling of the same. All of this type of operation minimizes any overheating, as is commonly experienced with various wrapping and banding machines currently in use. Speed of production thus is maximum as well as the sealed and re-constituted joints being of a highly uniform nature, in addition to minimizing the use of power and effecting longer life for the resistance element. In addition, upon starting the machine initially, the first seal and re-constituted connection formed thereby is of a completely satisfactory nature, as well as all subsequent seals and re-constituted connections.

In the preferred operation of the machine, as has been stated above, the firing of current to the resistance element 50 occurs only when the heater bar 16 and anvil bar 14 are adjacent each other. As a result, the forementioned generator, which is not illustrated, is of the type that is responsive to the pressurization of the bar-actuating, fluid-operated cylinder 40 incident to moving the bars 14 and 16 toward each other. Also, due to the extensive difference in lever arm of the short bar 132 and the lever 128 with respect to the pivot 130, it will be appreciated that mechanism including these elements is extremely sensitive to very small changes in expansion and contraction of the resistance element 50 and, correspondingly, it is sensitive to relatively small changes in temperature. As a result of this, during a sealing operation by the resistance element 50, the rise in temperature may be such that micro-switch 136 is activated to open the circuit but under such circumstances, the residual temperature is adequate to complete the sealing and re-constituting of the film or band of material. However, it will be seen from this that temperature control of the sealing and re-constituting means of the machine is possible to be controlled within relatively small temperature changes so as to insure no appreciable over-heating of the mechanism, whereby maximum efficiency in operation as well as speed of operation is assured, coupled with effective sealing and reconstituting of the material.

As indicated above, face strip 74 is detachable from heater bar 16 by unthreading bolts 156 therefrom. All supporting structure for heating element 50 is carried by strip 74, thus rendering the cleaning of the same easy when detached from bar 16.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. In a curtain-type overwrapping machine having an elongated anvil bar and an elongated heater bar carrying a resistance-type heater element extending along one surface of said heater bar for co-action with said anvil bar, and means to move at least one of said bars toward and from the other to effect sealing of thermoplastic sheet wrapping and/or banding material around an article and re-constituting said material into a continuous sheet or band thereof; the improvement comprising means adjacent one end of said heater bar to anchor one end of said resistance-type heater element thereto, an anchor block adjacent the other end of said heater bar supported for movement axially toward and from said other end of said heater bar, means to secure the opposite end of said heater element to said anchor block, expansible means operable between said anchor block and said other end of said heater bar to maintain said heater element taut under all conditions of expansion and contraction, a lever pivotally connected intermediately of its ends to said other end of said heater bar, means on one end of said lever engageable by said anchor block to move said lever about its pivot as said anchor block is moved axially of said heater bar in response to expansion and contraction of said heater element, an electrical thermal impulse generator on said machine operable to develop a high amperage current and discharge the same instantly, electrical circuit means connecting said generator to said heater element to develop electrical resistance therein and produce a plastic-fusing temperature in said heater element instantaneously when said generator discharges current to said heater element, and a normally closed micro-switch in said circuit having an actuator positioned adjacent the opposite end of said lever and engageable therewith to actuate said micro-switch to open it when elongation of said heater element reaches a predetermined maximum limit to interrupt the circuit to said heater element and thereby limit the amount of elongation of said heater element which can occur and the consequent maximum ambient temperature which can be generated by the continuous cycling of current to said heater element.

2. The improvement in curtain-type overwrapping machine according to claim 1 further including means to adjust the amount of elongation of said heater element to determine when the circuit is to be interrupted by said microswitch.

3. The improvement in curtain-type overwrapping machine according to claim 2 in which said means to adjust said amount of elongation of said heater element comprises a support for said micro-switch, and means operable to adjust said support to determine the position of the actuating member of said micro-switch for engagement by said pivoted lever.

4. The improvement in curtain-type overwrapping machine according to claim 1 in which the pivot for said lever is appreciably closer to said means on said one end thereof which is engageable by said anchor block than said pivot is to the opposite end of said lever which engages the actuator of said micro-switch, thereby rendering the actuation of said micro-switch and control of the circuit to the heater element responsive to very small changes in expansion and contraction of said heater element to minimize any tendency of the same to over heat.

5. The improvement in a curtain-type overwrapping machine according to claim 1 in which said heater bar is provided with a face strip along which said heater element extends and to which said anchoring means for the opposite ends of said heater element are attached for support, and said improvement further including means detachably connecting said face strip to the operative surface of said heater bar, whereby face strip and the element and means supported thereby and readily removable for convenience in cleaning and servicing the same.

6. The improvement in a curtain-type overwrapping machine according to claim 1 in which said means adjacent said one end of said heater bar to anchor said one end of said heater element comprises another anchor block, means to secure said one end of said heater element to said another anchor block, and additional expansible means similar to said first-mentiond expansible means operable between said one end of said heater bar and said another anchor block and cooperable with said first-mentioned expansible means to maintain said heater element taut and both of said expansible means also being similarly compressible when said heater element contracts upon the temperature thereof being reduced between discharges of current thereto, thereby minimizing overall movement of said heater element during expansion and contraction thereof by distributing such movement substantially equally to both ends thereof.

* * * * *